US005811731A

United States Patent [19]

Jacques et al.

[11] Patent Number: 5,811,731

[45] Date of Patent: Sep. 22, 1998

[54] FIRE BARRIER VENTILATION SEALING ASSEMBLY AND VENTILATION DEVICE EQUIPPED WITH SUCH A SEALING ASSEMBLY

[75] Inventors: Bureau Jacques, Ecully; Gibault Jacques, Lyon, both of France

[73] Assignees: Electricite de France-Service National, Paris; Mecatiss, Morestel, both of France

[21] Appl. No.: 621,495

[22] Filed: Mar. 25, 1996

[30] Foreign Application Priority Data

Mar. 23, 1995 [FR] France ..... 95 03439

[51] Int. Cl.[6] ..... E04B 1/94

[52] U.S. Cl. ..... 174/68.3; 52/232

[58] Field of Search ..... 174/68.3, 48; 52/232, 52/220.1, 220.7

[56] References Cited

U.S. PATENT DOCUMENTS

| | | | |
|---|---|---|---|
| 4,493,945 | 1/1985 | Feldman | 174/68 C |
| 5,398,467 | 3/1995 | Ricq et al. | 52/232 |

FOREIGN PATENT DOCUMENTS

| | | | |
|---|---|---|---|
| 102570 | 1/1985 | European Pat. Off. | H02G 3/04 |
| 225107 | 6/1987 | European Pat. Off. | H02G 3/22 |
| 544600 | 6/1993 | European Pat. Off. | H02G 3/16 |
| WO9322814 | 11/1993 | WIPO | H02G 3/04 |

*Primary Examiner*—Kristine L. Kincaid
*Assistant Examiner*—Joseph Waks
*Attorney, Agent, or Firm*—Sughrue, Mion, Zinn, Macpeak & Seas, PLLC

[57] ABSTRACT

This fire barrier ventilation device has a duct (15) surrounded by a sheath (28) made of fire barrier protective material. A fire barrier ventilation sealing assembly (22), formed by a frame having grilles (2, 3) fixed to refractory material plates (4, 5) each bearing a plate (10, 11) of intumescent material, is fixed to the duct facing a ventilation orifice or slit (20) in the latter. A ventilation passage (12) located facing the ventilation slit (20) of the duct (1) containing cables (C) to be protected is formed between the plates (10, 11) of intumescent material.

9 Claims, 1 Drawing Sheet

FIRE BARRIER VENTILATION SEALING ASSEMBLY AND VENTILATION DEVICE EQUIPPED WITH SUCH A SEALING ASSEMBLY

BACKGROUND OF THE INVENTION

The present invention relates to devices for protection against fire, in particular for electrical cables of feeder lines or the like.

Fire protection devices are already known which comprise sheaths through which the electrical cables pass and which are relatively insulating as regards the transmission of heat.

Such systems have the drawback that they do not permit dissipation of the heat released by the system to be protected. Such is the case, in particular, for power electrical cables, pipelines transporting hot fluids, motors and the like.

Consequently, a system which is protected against fire by a conventional sheath runs the risk of becoming excessively heated and of being damaged.

In order to overcome this drawback, fire protection arrangements have been designed which employ dynamic elements such as systems with shutters or straps, or else systems with closure elements displaced under the action of gravity or by the melting of elements which form wedges.

Such dynamic arrangements pose problems of long-term reliability.

In addition, French Patent No. 91 14 722 has also disclosed a fire barrier ventilation device with static elements which, for its part, has the drawback of limited size, which restricts its use to the protection of systems which produce only a limited amount of heat.

For larger systems, static-element ventilation devices of the type mentioned above are very bulky and cannot always be fitted.

SUMMARY OF THE INVENTION

The object of the invention is to overcome the drawbacks of the known devices by creating a fire barrier ventilation device which has a ventilation capacity that can be adapted to the heat energy dissipated by the system to be protected, so as to obtain ventilation which is equivalent to that of a system which is not protected.

A further object of the invention is to create a fire barrier ventilation device which is particularly practical to install.

The subject of the invention is therefore a fire barrier ventilation sealing assembly, characterized in that it includes a tubular openworked frame intended to be introduced into a ventilation orifice in a wall of a space to be protected, in which frame two plates made of controlled-expansion intumescent material are fixed opposite each other, defining between them a ventilation passage and closing off this passage as soon as the temperature of the sealing assembly reaches a determined value.

According to other characteristics of the invention:

the tubular openworked frame is formed by two openworked elements which are arranged face to face and are joined by refractory material plates which face each other and on which the plates made of controlled-expansion intumescent material are respectively fixed so as to face each other;

the openworked elements are grilles with edges folded at a right angle, by means of which the grilles are fixed to the refractory material plates;

those edges of the two grilles which are folded at a right angle and are fixed on the same refractory material plate are separated by a gap for breaking the thermal bridge between the two grilles;

the grilles are fixed to the refractory material plates by means of staples or screws;

the sealing assembly is in the form of a module with determined dimensions, which can be cut to length as required.

A further subject of the invention is a fire barrier ventilation device comprising at least one wall bounding a space to be protected, said wall being covered with a thermally insulating material, characterized in that at least one ventilation orifice provided with a fire barrier ventilation sealing assembly as defined above is provided in said at least one wall.

The invention will be better understood on reading the following description, given solely by way of example and made with reference to the appended drawings, in which:

DESCRIPTION OF A PREFERRED EMBODIMENT

Figure 1:
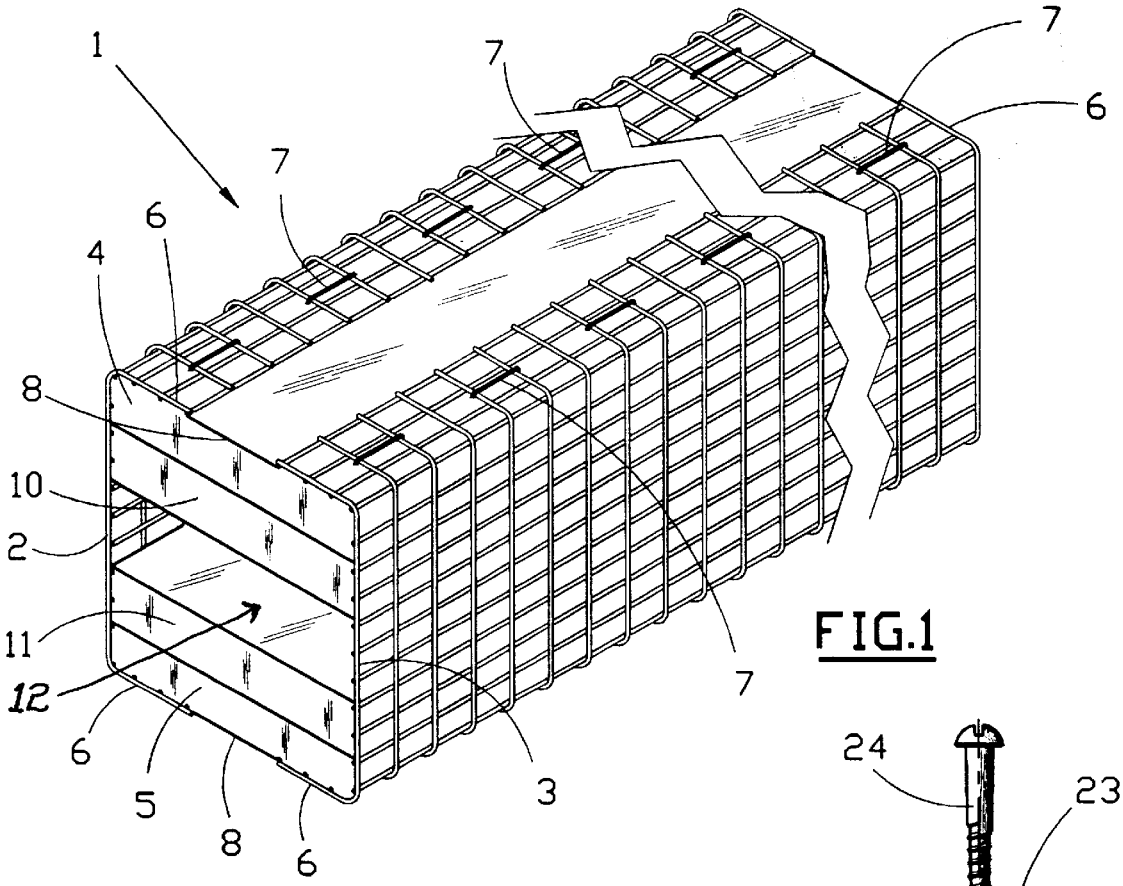
FIG. 1 is a perspective view of a fire barrier ventilation sealing assembly according to the invention.

The fire barrier ventilation sealing assembly represented in FIG. 1 mainly comprises an openworked tubular frame 1 formed, in the present embodiment, by two metal grilles 2 and 3 arranged face to face and joined by refractory material plates 4, 5. The grilles 2 and 3 comprise flanges 6 folded at a right angle, by means of which they are fixed to the refractory material plates 4, for example with the aid of staples 7 arranged at regular intervals.

Those folded edges 6 of the grilles 3 which are fixed on the same refractory material plate 4 or 5 are separated by a gap 8 for breaking the thermal bridge between the two grilles 2 and 3.

Plates 10, 11 made of controlled-expansion intumescent material, which define between them a ventilation passage 12, are respectively fixed, facing each other, on the refractory material plates 4 and 5.

The plates 10 and 11 made of intumescent material are advantageously fixed to the refractory material plates 4 and 5 by adhesive bonding.

The controlled-expansion intumescent material may be a silicone-based material. It is, for example, an intumescent material of type 335 S from the company MECATISS.

This material, which may be in rigid or flexible form, does not release any corrosive material such as halogens or sulfur.

The fire barrier ventilation sealing assembly represented in FIG. 1 is produced in the form of a module or cartridge, of predetermined length, for example 1 m. It can be cut to length as required, in order to furnish ventilation orifices of shorter length or else to complete the furnishing of a ventilation orifice which requires the juxtaposition of a plurality of ventilation sealing assemblies and the length of which does not correspond to a whole number of such sealing assemblies. It is advantageously factory-made.

The frame for holding the plates of intumescent material may also be made using an openworked metal tubular element such as, for example, a tubular grille of square or rectangular cross section.

Refractory material plates such as the plates 4 and 5 in FIG. 1 and plates of intumescent material, such as the plates 10 and 11, may then be arranged against two facing walls of such a tube.

Plates of intumescent material fixed directly to the corresponding walls of the tubular grille forming the frame may also be placed in a tubular frame of the aforementioned type.

Figure 2:
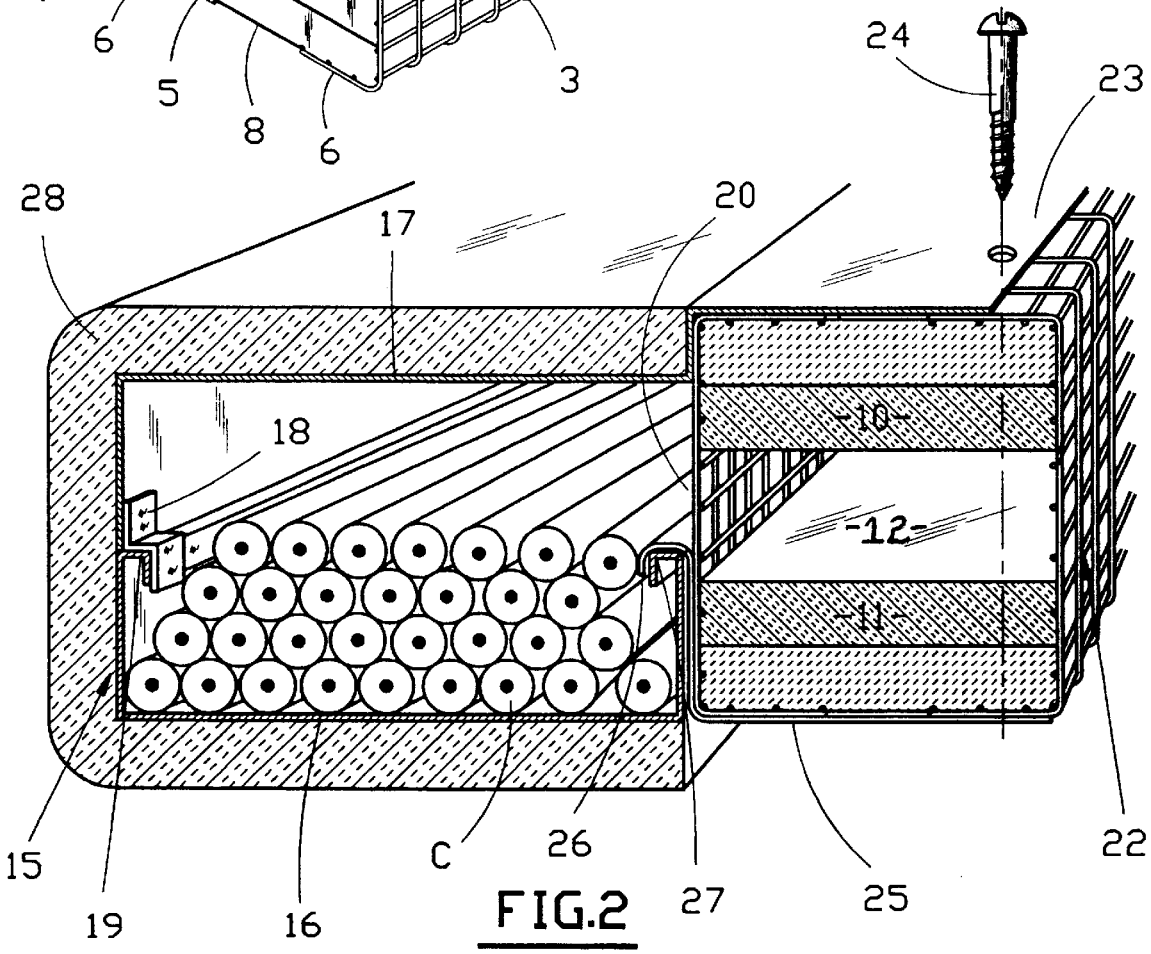
FIG. 2 is a view in perspective and in cross section of a fire barrier ventilation device intended for protecting power cables and equipped with a fire barrier ventilation sealing assembly according to the invention.

FIG. 2 represents, in perspective, a fire barrier ventilation device using modular or cartridge fire barrier ventilation sealing assemblies, such as the one represented in FIG. 1.

This ventilation device comprises a sheet-metal duct 15 formed by assembling a lower part 16 and an upper part 17, which are fixed to each other along a vertical side of the duct by lugs 18 which are securely fastened to the upper part 17 and cooperate with a folded flange 19 of the lower part 2.

Along the vertical side wall opposite the lugs 18 and the flange 19, the duct has a ventilation orifice in form of a longitudinal slit 20, in front of which a fire barrier ventilation sealing assembly 22 according to the invention is arranged, such as the one described with reference to FIG. 1.

The fire barrier ventilation sealing assembly 22, which may consist of one or more juxtaposed cartridges of determined length, is fixed to a projecting flange 23 of the upper part 17 of the duct 15, for example by means of screws such as the screw 24, or else by means of staples similar to the ones which fix the grilles 2 and 3 on the refractory material plates 4 and 5 of the fire barrier ventilation sealing assembly represented in FIG. 1.

The sealing assembly 22 is also fixed to the lower part 16 of the duct 15 by brackets 25, each provided with a hook 26 cooperating with a folded flange 27 of that vertical side wall which lies opposite the one containing the flange 19 cooperating with the lugs 18 on the upper part 17 and which defines, with the upper part 17, the ventilation slit 20 of the duct.

The duct 15 is surrounded by a sheath 28 of fire barrier protective material.

This is, for example, a thermally insulating material such as, for example, ceramic wool in superposed layers with the interposition of adhesive between the layers and a covering of a similar type of fabric arranged on the external face of the outer layer of ceramic wool.

It is therefore seen that the two parts 16 and 17 of the duct 15 are assembled, on the one hand, by the cooperation of the hooks 18 and of the flange 19 and, on the other hand, by the fire barrier ventilation sealing assembly 22 being fixed to the flanges 23 of the upper part 17 and to the side wall of the lower part 16 of the duct, via the fastening lugs 25.

By virtue of the arrangement in FIG. 2, the duct 15 protects from fire the cables C which it contains, while ventilating them under normal operating conditions, making it possible to dissipate the heat which they produce through the ventilation slit 20 of the duct which opens into the ventilation passage 12 formed between the plates 10, 11 of intumescent material of the fire barrier ventilation sealing assembly 22.

When the temperature rises, for example as a result of a fire starting in the room through which the duct 15 passes, the intumescent material of the plates 10 and 11 inflates to cause the ventilation slit 20 to be closed off. The inflation of the intumescent material is limited by the grilles 2, 3 of the frame, which confines its expansion to the volume which they define with the refractory material plates.

It is therefore seen that, by virtue of the arrangement which has just been described, a fire barrier protection device is obtained which, while providing suitable ventilation of systems which dissipate heat during their normal operation, provides suitable protection against fire by closing off the vent orifices formed in the walls of the protection device, because of the both controlled and limited inflation of the intumescent material contained in the fire barrier vent sealing assemblies with which the ventilation devices are equipped.

In addition, such a device is particularly simple to fit, insofar as fire barrier modular ventilation sealing assemblies according to the invention are in the form of cartridges, of defined length, which can be cut as required, according to the length of the ventilation passage to be equipped with such a sealing assembly, and which require only simple screwing and/or stapling operations in order to fit them.

What is claimed is:

1. A fire barrier ventilation sealing assembly, characterized in that it includes a tubular openworked frame (2, 3, 4, 5) intended to be introduced into a ventilation orifice (20) in a wall of a space to be protected, said frame comprising two plates (10, 11) which are made of a controlled-expansion intumescent material and which are fixed opposite each other, said two plates defining between them a ventilation passage (12) and closing off said passage as soon as the temperature of the sealing assembly reaches a determined value, wherein said sealing assembly is in the form of a module with determined dimensions, which can be cut to length as required.

2. The ventilation sealing assembly according to claim 1, characterized in that the tubular openworked frame is formed by two openworked elements (2, 3) which are arranged face to face and are joined by refractory material plates (4, 5) which face each other and on which the two plates (10, 11) made of said controlled-expansion intumescent material are respectively fixed so as to face each other.

3. The ventilation sealing assembly according to claim 2, characterized in that the openworked elements have edges (6) folded at a right angle, by means of which said element are fixed to the refractory material plates (4, 5).

4. The ventilation sealing assembly according to claim 3, characterized in that said edges (6) of the two elements which are folded at said right angle and are fixed on said refractory material plates are separated by a gap (8) for breaking a thermal bridge between the two elements (2, 3).

5. The ventilation sealing assembly according to claim 3, characterized in that said elements grilles one which are fixed to the refractory material plates by means of staples (7) or screws.

6. The ventilation sealing assembly according to claim 1, characterized in that the controlled-expansion intumescent material is a silicone-based material.

7. A fire barrier ventilation device comprising at least one wall bounding a space to be protected, said wall being covered with a thermally insulating material, wherein, in said at least one wall, there is at least one ventilation orifice (20) provided with a fire barrier ventilation sealing assembly comprising a tubular openworked frame (2, 3, 4, 5) inserted in said ventilation orifice, said frame comprising two plates (10, 11) which are made of a controlled-expansion intumescent material and which are fixed opposite each other, said two plates defining between them a ventilation passage (12) and closing off said passage as soon as the temperature of the sealing assembly reaches a determined value, said sealing assembly being in the form of one or more juxtaposed cartridges of determined length corresponding to length of said ventilation orifice.

8. Fire barrier ventilation device according to claim 7, for the protection of power electrical cables arranged in a duct (15), characterized in that said duct comprises the ventilation orifice (20) against which said fire barrier ventilation sealing assembly (22) is mounted.

9. Fire barrier ventilation device according to claim 8, characterized in that the duct (15) comprises a projecting flange (23) to which the fire barrier ventilation sealing assembly is fixed by screws (24) or staples, and in that the ventilation orifice (20) of the duct is bounded by said flange (23) and a folded flange (27) of a duct side wall to which the ventilation sealing assembly is fixed by means of brackets (25) provided with hooks (26) cooperating with said folded flange.

* * * * *